US005078189A

United States Patent [19]

Ronsonet

[11] Patent Number: 5,078,189

[45] Date of Patent: Jan. 7, 1992

[54] ADJUSTABLE FUNNEL APPARATUS

[76] Inventor: Willis Ronsonet, 400 Kathryn St., New Iberia, La. 70560

[21] Appl. No.: 610,825

[22] Filed: Nov. 8, 1990

[51] Int. Cl.[5] ..... B67C 11/00

[52] U.S. Cl. ..... 141/337; 141/331; 141/392

[58] Field of Search ..... 141/331, 337, 338, 398; 383/63, 2, 65

[56] References Cited

U.S. PATENT DOCUMENTS

| | | | |
|---|---|---|---|
| 427,874 | 5/1890 | Jones | 141/765 |
| 719,820 | 3/1903 | Leigh | 141/331 |
| 2,100,888 | 11/1937 | Vine | 141/337 |
| 2,158,688 | 5/1939 | Brooks | 141/337 UX |
| 2,321,639 | 6/1943 | Zarbo | 141/331 X |
| 2,456,912 | 12/1948 | Burrows | 141/337 X |
| 2,605,582 | 8/1952 | Allen | 141/391 X |
| 3,572,318 | 3/1971 | Garland | 141/337 X |
| 4,108,222 | 8/1978 | Kaufman | 141/337 |
| 4,354,541 | 10/1982 | Tilman | 383/63 |
| 4,532,652 | 7/1985 | Herrington | 383/63 X |
| 4,578,813 | 3/1986 | Ausnit | 383/65 |
| 4,751,751 | 6/1988 | Reno | 141/337 X |
| 4,896,707 | 1/1990 | Cowles | 141/337 |

FOREIGN PATENT DOCUMENTS

| | | | |
|---|---|---|---|
| 2497786 | 7/1982 | France | 141/337 |

*Primary Examiner*—Ernest G. Cusick
*Attorney, Agent, or Firm*—Pravel, Gambrell. Hewitt, Kimball & Krieger

[57] ABSTRACT

An apparatus which includes a rectangular sheet of flexible plastic, the first face of the sheet which includes a plurality of parallel spaced apart channels, and the second face of the sheet including a pair of raised members, one raised member positioned substantially along a first edge of the sheet, and the second raised member positioned substantially perpendicular thereto along the bottom edge of the sheet, so that when the sheet is configured into a funnel shape, one of the raised locking members is mated into the channel members, to form a sealed juncture thereon, and for defining a sealed cone having an enlarged upper end and a reduced lower spout end, defining an overall funnel member.

7 Claims, 2 Drawing Sheets

ADJUSTABLE FUNNEL APPARATUS

BACKGROUND OF THE INVENTION

1. Field of the Invention

The present invention relates to funnels. More particularly, the present invention relates to an adjustable funnel apparatus which includes a flat elongated wall portion shapable into a cone, and sealed along a common edge for defining a funnel having varied size flow ports depending on the sealing portion utilized.

2. General Background

The concept of the funnel has been a part of the technology of man for many centuries, and is a basic tool utilized in all facets of every day life. However, funnels, as they presently exist comprise in most cases a cone shaped member usually constructed of inflexible solid material such as metal or in recent times a plastic material, which includes a spout at its lowermost end for moving fluids from the large container portion of the funnel into the reduced area of the spout in order to move the fluids into a port such as the mouth of a bottle, or in the cases of the automotive industry, into the oil fill hole of an engine.

In the present concept of funnels, there are two basic problems encountered in a use of every day funnels. One problem addresses the relative size of the funnel vis-a-vis the size of the pour spout. Because of the nature of a funnel and the many uses that a funnel can be put to, it is required that funnels come in various sizes so that various types of uses can be easily accommodated depending on the port that the fluid is being poured into. The second problem surrounds the storage of funnels when they are not in use. If one is to have a multitude of funnels in order to undertake various types of pouring tasks, then the storage of the funnel requires a great deal of space due to its shape and usual rigid configuration.

Therefore, there is a need for a solution to both of these problems in that one can see the benefits in having a funnel which would occupy a limited amount of space, and have the ability to be adjusted into various size configurations for the particular task to be undertaken.

In a review of the art in this field, reference is made to the following patents which were found as a result of a search conducted in the U.S. Patent and Trademark Office:

| PATENT NO. | TITLE | ISSUE DATE |
|---|---|---|
| 4,751,751 | Disposable Urinating Funnel For Females | 06/21/88 |
| 4,062,387 | Disposable Funnel Apparatus | 12/13/77 |
| 2,456,912 | Collapsible and Adjustable Filter and Strainer | 12/21/48 |
| 4,825,915 | Funnel Construction System | 05/02/89 |
| 4,108,222 | Collapsible Disposable Funnel | 08/22/78 |
| 4,896,707 | Adjustable, Disposable Funnel | 01/30/90 |

SUMMARY OF THE PRESENT INVENTION

The apparatus of the present invention solves the problems in the art in a simple and straightforward manner. What is provided is an apparatus which includes a rectangular sheet of flexible plastic, the first face of the sheet which includes a plurality of parallel spaced apart channels, and on the second face of the sheet including a pair of raised members, one raised member positioned substantially along a first edge of the sheet, and the second raised member positioned substantially perpendicular thereto along the bottom edge of the sheet, so that when the sheet is configured into a funnel shape, one of the raised locking members is mated into the channel members, to form a sealed juncture thereon, and for defining a sealed cone having an enlarged upper end and a reduced lower spout end, defining an overall funnel member.

The plurality of channels provide the funnel, defined by the mated portions, as an adjustable funnel that, depending on the member mated, enlarges or reduces both the upper portion and the lower spout portion of the funnel depending on the use. For purposes of construction, the locking means of the funnel is the type of locking means that is utilized in a ZIPLOCK® bag, which is a registered trademark owned by Dow Chemical Company Corporation, and is being utilized as a component in the present invention.

Therefore, it is the principal object of the present invention to provide a flexible sheet that can be manipulated into a cone shaped funnel and sealed along a common edge so as to define a usable funnel;

It is a further object of the present invention to provide a funnel that can be stored very easily in a reduced amount of space, and upon configuration, configure into a usable funnel apparatus;

It is further principal object of the present invention to provide a funnel apparatus which can adjust into a plurality of sizes, so that the diameter of the end spout of the funnel can be adjustable depending on the sealing or the locking member that is sealed along the common edge.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
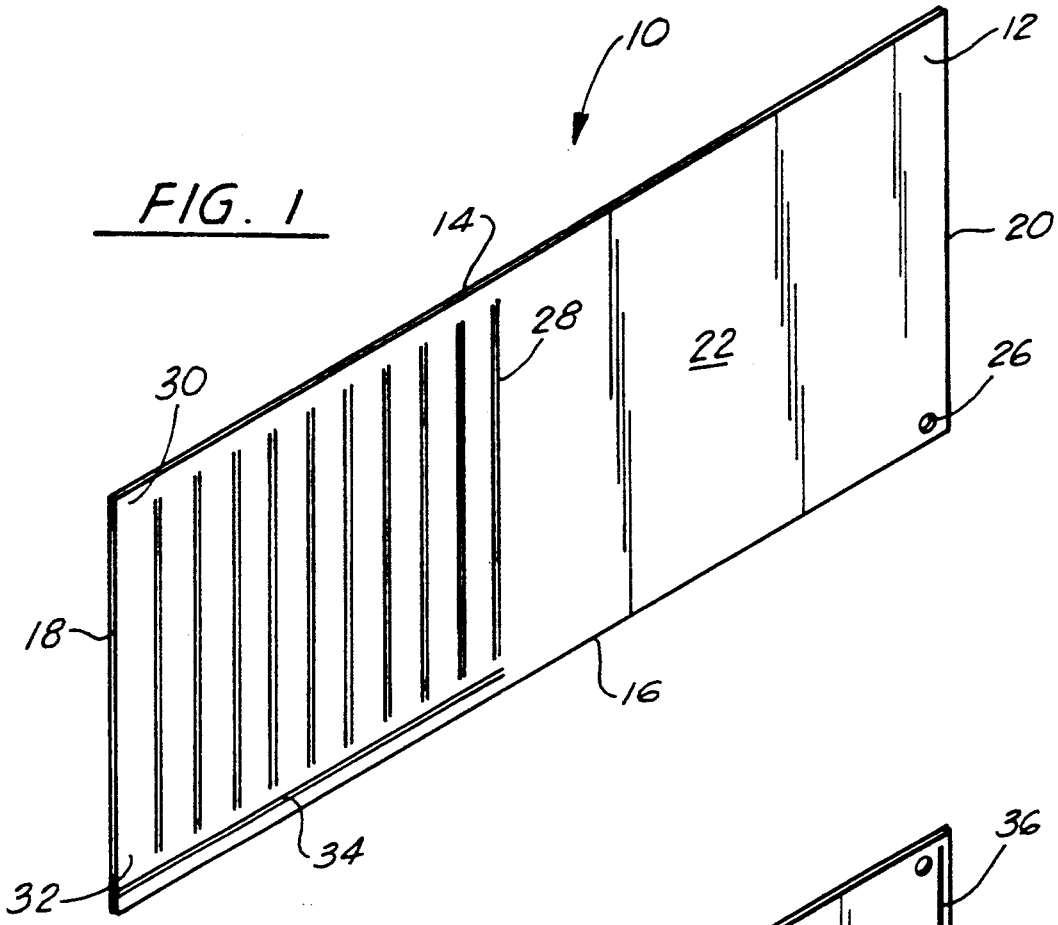
FIG. 1 illustrates an overall view of a first face of the apparatus of the present invention.
Figure 2:
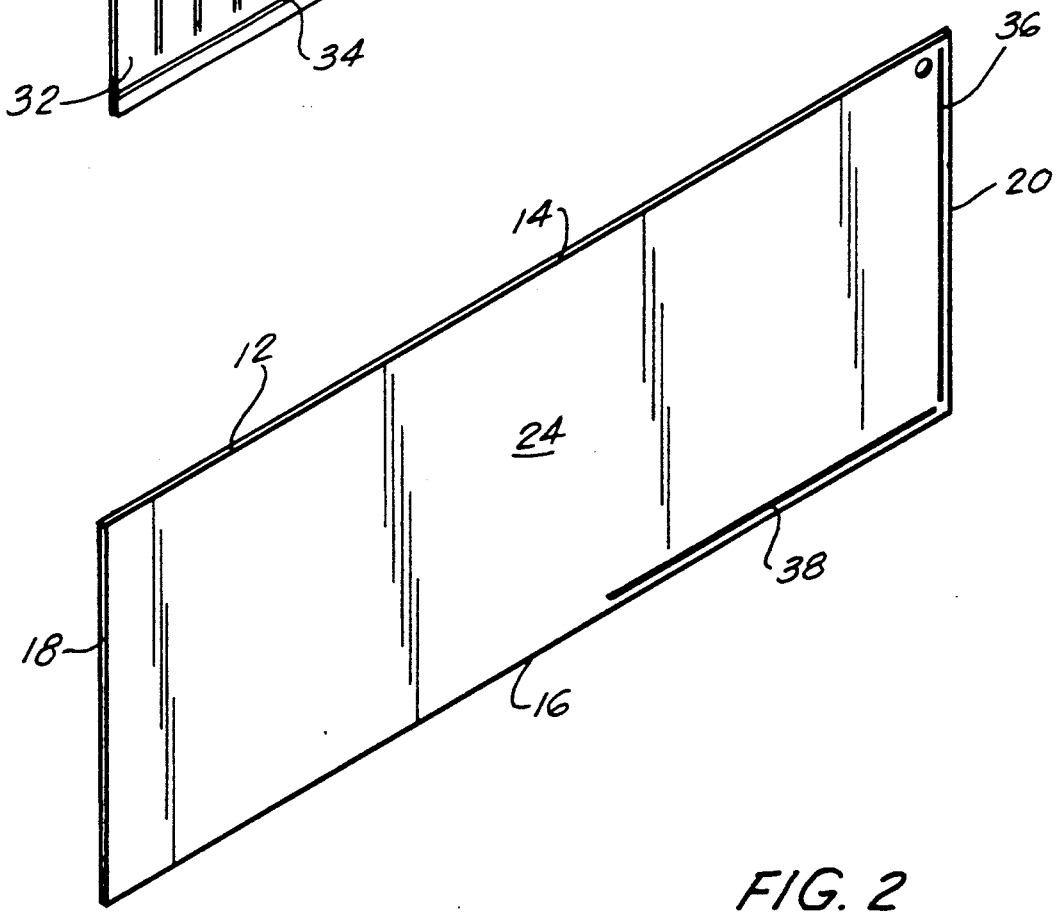
FIG. 2 illustrates an overall view of a second face of the overall apparatus of the present invention.

FIGS. 1–4 illustrate the preferred embodiment of the apparatus of the present invention by the numeral 10. As illustrated, apparatus 10 would comprise generally a flat rectangular sheet member 12 which would be constructed of a flexible material such as plastic or the like of a thickness so that the member could be easily configured into a cone shape as will be discussed further. Sheet member 12 would be rectangular in shape having an upper first edge 14, a lower edge 16 substantially parallel to the first edge 14, a left vertical edge 18 and a right vertical edge 20 parallel with edge 18 to configure a substantially rectangular sheet as illustrated. The sheet would further comprise a forward face 22 as illustrated in FIG. 1 and a rear face 24 as illustrated in FIG. 2.

In the configurations as illustrated in FIGS. 1 and 2 there is further illustrated a port 26 through a one corner of the apparatus, which would allow it to be stored by hanging from a nail or the like from that port, in the flat configuration as illustrated, or it could be stored on a shelf or the like quite easily and occupy little space during storage.

As illustrated, apparatus 10 would further comprise on its first face 22 a plurality of channel members 28. As illustrated in this particular embodiment there are illustrated a total of ten channel members 28 extending from the upper portion 30 along the first edge 14 down to the lower portion 32 of the face 22, each of the channel members being in parallel relationship thereto. For purposes of use, as will be discussed further, the channel members would preferably be spaced a particular distance apart, for example ¼ of an inch or ⅛ of an inch apart which would effect the resulting size of the spout of the apparatus again as will be discussed further. Further, as illustrated, there is a channel 34 which is along the bottom edge 16 of face 22, and substantially parallel thereto extending from the side edge 18 and running to the furthest most channel 28, the function of which will be described further.

Turning now to the configuration of face 24, there is illustrated a raised locking member 36 running substantially along the width of face 24 adjacent the edge 20 of the apparatus, and a second raised locking member 38 running a distance along the bottom edge 14 of face 24, and being substantially perpendicular to the alignment of locking member 36. The locking members 36 and 38 work in conjunction with the channels 28 and 34 as will be explained further.

First, in order to clarify the manner in which the raised members 36, 38 lock with channel members 28, 34, reference is made to a product known in the market as a ZIPLOCK ® attachment. ZIPLOCK ® is registered trademark owned by Dow Chemical Company Corporation, and is very commonly used in the sealing of storage of plastic bags for placing food in freezers or lunch boxes or the like. The manner in which the "ziplock" locking system works is that a raised locking member very similar to raised locking members 36, 38 are forced into a channel very similar to channels 28, 34, along their entire length, so that once one has placed pressure between the locking member and the channel along the length of the bag, the locking member is forced into the channel, and is therefore "ziplocked" in place, and is a very effective sealing means in keeping fluids or air from traveling between the locked space.

Figure 3:
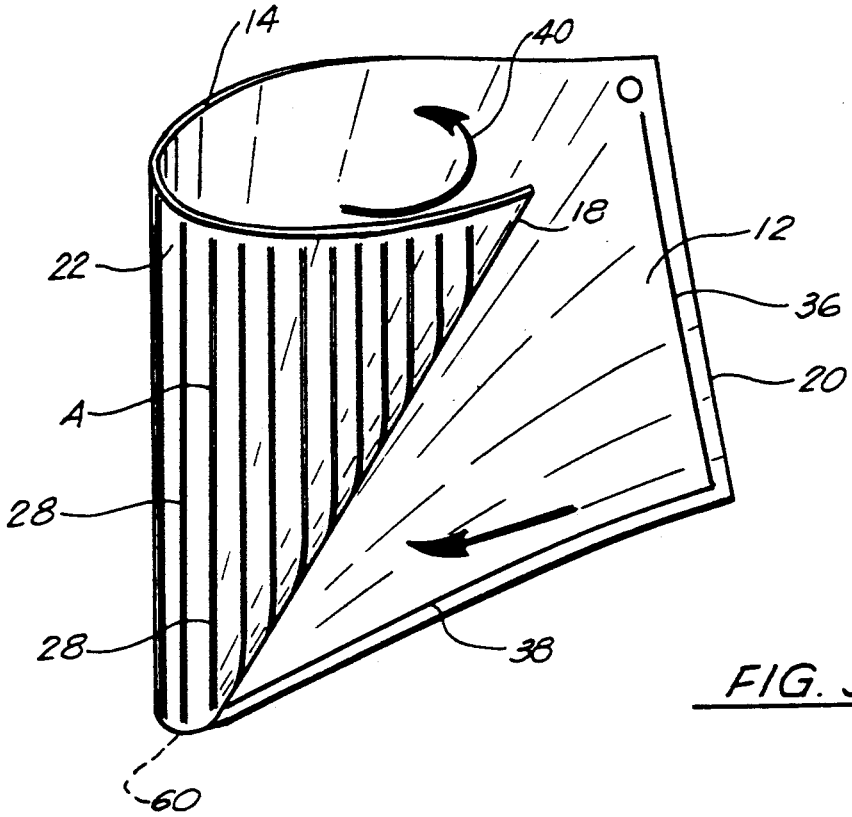
FIG. 3 illustrates an overall view of the apparatus of the present invention being configured into a funnel apparatus.
Figure 4:
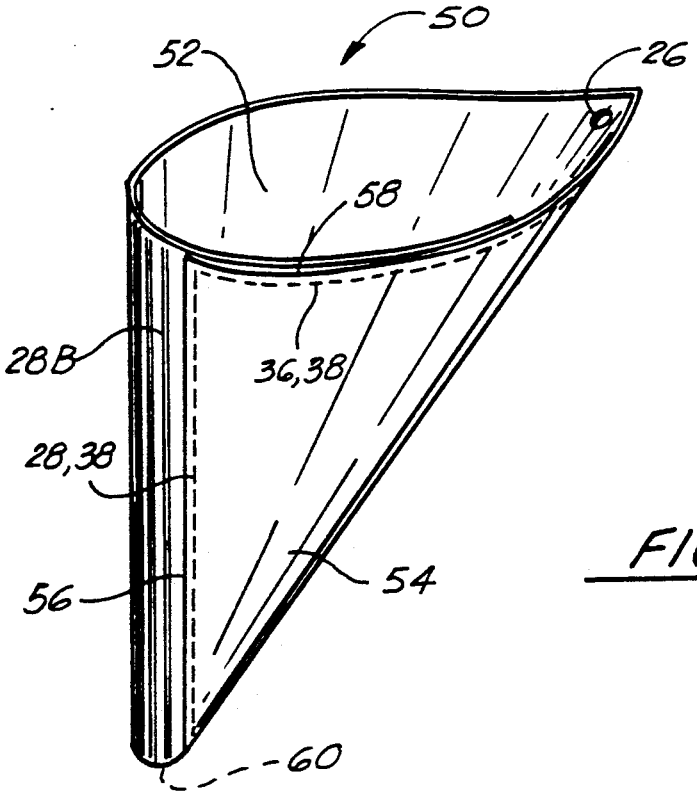
FIG. 4 illustrates an overall view of the apparatus of the present invention after the apparatus has been totally configured into a funnel shape.

With that locking concept in mind, reference is made now to FIGS. 3 and 4 of the apparatus, which illustrates the manner in which the apparatus is configured into a shape to function as an adjustable funnel apparatus 50 as illustrated in FIG. 4. It is quite commonplace that if one takes a substantially rectangular sheet as illustrated in FIGS. 1 and 2, that if one were to configure the positioning of the sheet as illustrated in FIG. 3, by rotating one face of the sheet in a circular fashion, that the sheet could be configured into a funnel apparatus as illustrated in FIG. 4. With that general concept in mind which is quite commonly known, reference is made to FIG. 3 where it is seen that the edge 18 of the apparatus has been formed into a circular pattern in the direction of arrow 40, and face 22 having the plurality of channel members 28 is being circulated around so that one of the parallel channel members 28 is brought into parallel locking alignment with horizontal raised locking member 38, and horizontal channel member 34 is brought into parallel locking alignment with vertical raised locking member 36 along edge 20, as illustrated in phantom view in FIG. 4. Therefore, once the locking members have been pressed into locking relationship as with a ZIPLOCK ® locking arrangement, FIG. 4 would define the funnel member 50 having an upper enlarged spout area 52, a continuous annular wall portion 54 which is then sealed along a common edge 56 via locking members 28, 38 and sealed along a top edge 58 via the locking relationship of locking members 34, 36. Further, as illustrated there would be further defined a reduced downspout opening 60 which is formed as a result of the manner in which the rectangular sheet 12 is placed into the configuration as illustrated.

Turning now to the plurality of channel members 28 as they would configure into locking relationship with raised members 34, 36, as was discussed earlier, each of the channel members 28 are positioned in parallel relationship for defining a specific dimensional distance therebetween. Therefore, this dimensional distance as defined by the letter A in FIG. 3, results in a particular configuration of the diameter of downspout 60. Therefore, as raised locking edge 38 is configured into locking engagement with a particular channel 28, the diameter of the downspout 60 formed thereby is of a dimension in direct relation to the change in the distance between the parallel channels 28. For example, if one were to assume that the diameter of downspout 60 in FIG. 4 is ½ inch in the position that locking channel 28 locks with raised locking member 38, then were locking member 38 moved to the next channel 28B, as illustrated in FIG. 4, if that distance would be for example ¼ of an inch, then the diameter of the downspout 60 would be reduced ¼ of an inch. Therefore, with this relationship in mind, it is foreseen that the plurality of channels 28 allow one therefore to matingly engage a particular channel 28 with locking member 38, depending on the diameter of downspout 60 that one wishes to achieve in the final configuration of funnel member 50.

It should be fully understood that this particular embodiment should not be limiting in the sense that the plurality of channel member 28 do not necessarily have to be evenly spaced apart, but could be configured into a particular dimensional arrangement i.e. one inch apart or even having a plurality of channel members along face 22 which would allow one to configure the funnel in a single funnel size, or in two or three or more funnel sizes depending on the location of the channel members 28. Therefore, it is foreseen that the sheets could be formed in many configurational sizes, and not limited to the sizes as illustrated in the Figures.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An adjustable funnel apparatus comprising:

a) a substantially flexible sheet member, having a first face and a second face;

b) at least one first channel running substantially along the width of said first face;

c) a second channel running along a portion of the length of the first face and substantially perpendicular to the positioning of the at least one first channel;

d) a first raised locking member running along adjacent an edge of the second face of the sheet member;

e) a second raised locking member running along the lower edge of the second face and substantially perpendicular to the alignment of the first locking member;

f) means for positioning the sheet member into a configuration so that one of the at least one first channel lockingly mates with the second raised locking member and the second channel mates with the first locking member, for defining a funnel shaped apparatus sealed by the locking engagement of one of the at least one first channel and the second channel to the second and first locking members respectively.

2. The apparatus in claim 1, wherein the sheet member is substantially rectangular in configuration.

3. The apparatus in claim 1, wherein the sheet member is constructed of a flexible plastic material.

4. The apparatus in claim 1, wherein the at least one first channel and the second channel are configured substantially in the configuration as a ZIPLOCK® channel member.

5. The apparatus in claim 1, wherein the first and second raised locking members are configured as a ZIPLOCK® raised channel locking member.

6. The apparatus in claim 1, wherein the apparatus may further comprise a plurality of said at least one first channel aligned substantially in parallel relationship for defining an adjustable downspout portion of the apparatus when the first and second locking members are in locking engagement with the second channel and one of the at least one first channel respectively, wherein each of the plurality of said at least one first channel are formed in substantially $\frac{1}{4}$ inch increments thereapart, and therefore resulting in a downspout of substantially $\frac{1}{4}$ inch diameter adjustments.

7. An adjustable funnel apparatus comprising:

a) a substantially flexible rectangular shaped sheet member, having a first face and a second face;

b) at least a plurality of first channels running substantially along the width of said first face;

c) at least a second channel running along a portion of the length of the first face in substantially perpendicular to the positioning of the at least one of the plurality of first channels;

d) a first raised locking member extending adjacent an edge of the second face of the sheet member;

e) a second raised locking member running along a lower edge of the second face in substantially perpendicular to the alignment of the first locking member;

f) means for positioning the sheet member into a configuration so that one of the at least a plurality of first channels lockingly mates with the second raised member and the at least a second channel mates with the first locking member, for defining a funnel shaped apparatus sealed by the locking engagement of one of the at least a plurality of first channels and the at least a second channel to the second locking member and the first locking member respectively.

* * * * *

UNITED STATES PATENT AND TRADEMARK OFFICE

CERTIFICATE OF CORRECTION

PATENT NO. : 5,078,189

DATED : JANUARY 7, 1992

INVENTOR(S) : WILLIS RONSONET

It is certified that error appears in the above-identified patent and that said Letters Patent is hereby corrected as shown below:

In the drawings:

In Fig. 2, change "14" to --16-- and change "16" to --14--;

In Fig. 3, change "14" to --16-- and change "16" to --14--; and

In Fig. 4, change "36, 38" to --34, 36--.

Signed and Sealed this

Eighth Day of June, 1993

Michael K. Kirk

MICHAEL K. KIRK

*Acting Commissioner of Patents and Trademarks*

*Attest:*

*Attesting Officer*